US007159376B2

(12) United States Patent
Taylor

(10) Patent No.: US 7,159,376 B2
(45) Date of Patent: Jan. 9, 2007

(54) ROTARY PACKAGING MACHINES

(75) Inventor: Alfred A. Taylor, Lugarno (AU)

(73) Assignee: TNA Australia Pty Limited, Lidcombe (AU)

( * ) Notice: Subject to any disclaimer, the term of this patent is extended or adjusted under 35 U.S.C. 154(b) by 574 days.

(21) Appl. No.: 10/317,848

(22) Filed: Dec. 11, 2002

(65) Prior Publication Data

US 2003/0136092 A1 Jul. 24, 2003

(30) Foreign Application Priority Data

Dec. 12, 2001 (AU) ..... PR9455

(51) Int. Cl.
*B65B 9/20* (2006.01)
*B65B 51/10* (2006.01)

(52) U.S. Cl. ..... 53/550; 53/374.9

(58) Field of Classification Search ..... 53/374.9, 53/374.8, 373.7, 552, 551, 371.8, 371.9, 53/550

See application file for complete search history.

(56) References Cited

U.S. PATENT DOCUMENTS 1,993,442 A * 3/1935 Greven ..... 53/374.8
2,852,898 A 9/1958 Berg
3,326,097 A * 6/1967 Lokey ..... 53/552
3,849,965 A 11/1974 Dominici
4,048,003 A 9/1977 Bolli
4,391,081 A 7/1983 Kovacs
4,532,753 A 8/1985 Kovacs
4,563,862 A 1/1986 McElvy
4,566,253 A 1/1986 Jones
4,663,917 A 5/1987 Taylor et al.
4,676,051 A * 6/1987 Hoskinson et al. ..... 53/552
4,759,170 A 7/1988 Sawa et al.
4,922,650 A * 5/1990 Akao et al. ..... 53/552
4,947,618 A 8/1990 Schneider et al.
4,965,985 A * 10/1990 Masubuchi et al. ..... 53/374.8
4,999,974 A 3/1991 Kovacs et al.
5,463,851 A 11/1995 Nagai
5,622,032 A 4/1997 Ryan
5,622,033 A 4/1997 Fukuda
5,881,539 A 3/1999 Fukuda et al.
6,006,503 A 12/1999 Davison et al.
6,052,971 A 4/2000 Malsam et al.
6,119,438 A * 9/2000 Bacon et al. ..... 53/552
6,189,301 B1 2/2001 Nakagawa et al.
6,367,230 B1 4/2002 Fukuda
6,519,922 B1 * 2/2003 Matheyka et al. ..... 53/552
2002/0092271 A1 7/2002 Kovacs et al.

FOREIGN PATENT DOCUMENTS

EP 0666215 A1 8/1995
EP 0959003 A1 11/1999
GB 1444374 A 7/1976

(Continued)

*Primary Examiner*—Stephen F. Gerrity
(74) *Attorney, Agent, or Firm*—Townsend and Townsend and Crew LLP

(57) ABSTRACT

A rotary packaging machine 10 having rotatably driven stripper bars 17 and 18 that strip tubular bag material 36 prior to sealing of the bags being formed. To further inhibit material being located between the sealing jaws there is provided tube closer bars 28 and 29. The bar 28 has a longitudinally extending projection 34 that is received within a longitudinally extending recess 35 of the bar 29. The tubular bag material 36 by engagement within the recess 35 by the projection 34 laterally projects the bag material 36 and three longitudinally spaced locations 54.

13 Claims, 11 Drawing Sheets

FOREIGN PATENT DOCUMENTS

| | | | |
|---|---|---|---|
| JP | 07132907 | A | 5/1995 |
| JP | 08040403 | A | 2/1996 |
| JP | 11180401 | A | 7/1999 |

* cited by examiner

ROTARY PACKAGING MACHINES

TECHNICAL FIELD

The present invention relates to rotary packaging machines and more particularly but not exclusively to rotary packaging machines used to package snack foods.

BACKGROUND OF THE INVENTION

Disclosed in U.S. Pat. No. 4,663,917 is a rotary packaging machine. The machine includes a pair of sealing jaws that are rotatably driven about parallel spaced generally horizontal axes. Associated with the jaws are stripper members which strip the bag material to inhibit product being located between the sealing jaws. Also associated with the sealing jaws are closer bars that engage the tubular bag material to again inhibit product being located between the jaws.

As the sealing jaws engage the tubular bag material they are generally travelling at the same speed as the bag material. However since the jaws are corrugated the bag material upstream of the jaws is accelerated. This in turn causes the bag material to move between the closer bars to the extent that the bag material initially above the closer bars passes through the closer bars to be located immediately below the closer bars just prior to sealing. This can result in product above the closer bars, particularly in the case of snack foods where there are crumbs, being pulled past the closer bars. This in turn can result in the location of product, such as crumbs, in the area between the sealing jaws. This results in an inferior seal and frequently in the bag material being punctured.

Previous packaging machines are described in patent specifications U.S. Pat. Nos. 6,367,230, 6,189,301, 6,052,971, 6,006,503, 5,881,539, 5,622,033, 5,622,032, 5,463,851, 4,999,974, 4,947,618, 4,759,170, 4,663,917, 4,566,253, 4,563,862, 4,532,753, 4,391,081, 3,849,965, JP 11180401, JP 8040403, JP 07132907.

With respect to U.S. Pat. No. 6,052,971, there is described therein a packaging machine provided with "wiper means" in the form of overlapping engagement portions that strip the bag material and cause the bag material to move upwardly relative to the sealing jaws. U.S. Pat. No. 4,566,253 describes a packaging machine that includes a series of interacting rollers that move the bag material upwardly to thereby strip the bag material by causing the bag material to move between a pair of stripping jaws. The interacting rollers reciprocate lineally in a direction generally transverse of the bag material. U.S. Pat. No. 6,189,301 describes a packaging machine having squeezing bars that are caused to oscillate angularly through approximately 45° to engage the bag material to inhibit product passing through the bag material and being engaged by the sealing jaws. The squeezing bars are mounted separately to the sealing jaws and do not rotate therewith.

The machines described in the above-identified patent specifications do not overcome the above-described problem.

SUMMARY OF THE INVENTION

It is an object of the present invention to overcome or substantially ameliorate the above disadvantage.

There is disclosed herein a rotary packaging machine including:

a pair of rotatably driven jaws to engage tubular bag material passing through the machine in a general direction of travel, the jaws being adapted to form transverse seals in the bag material to form discrete bags containing product;

a drive member supporting each jaw, the drive members being driven in synchronism in opposite rotational directions; and an assembly to at least substantially prevent product being located between the jaws during sealing engagement with the tubular bag material, the assembly having a first operative configuration allowing product to pass along the bag material and a second operative configuration, the assembly when in the second configuration being engaged with the bag material to at least substantially prevent product being located between the jaws during sealing, the assembly including bag material deflecting and closing members mounted on the drive members so as to rotate therewith, which deflecting and closing members close the bag material and deflect the closed bag material laterally relative to the direction to at least substantially prevent product being located between the jaws when forming the seals.

Preferably, the deflecting and closing members include:

a pair of bar members which deflect and close the tubular bag material, a deflector bracket for each bar member, each bracket mounting the associated one of the bar members on a respective one of the drive members, and wherein the brackets provide for relative movement between each bar member and the jaw of the respective drive member so that each bar member moves relative to its associated jaw when the bar member is engaged with the tubular bag material.

Preferably, the bar members deflect the tubular bag material laterally in one direction and laterally in the opposite direction to the one direction.

Preferably, the bar members are configured to also close the bag material; and the machine further includes strippers that engage the bag material downstream of the bar members in the direction to strip the bag material prior to sealing, the strippers being mounted on the drive members so that each drive member has mounted on it one of the bar members and one of the strippers.

Preferably, each deflector bracket is pivotally mounted on its respective drive member so that the bar member moves angularly relative to the respective one of the drive members, and the machine further includes a pair of stripper brackets that support the strippers, each stripper bracket being pivotally mounted on a respective one of the drive members so that the strippers move angularly relative to their respective drive members.

Preferably, the machine further includes first springs urging the bar members to a predetermined position from which the bar members are angularly moved relative to the drive members upon engagement with the bag material, and second springs urging the strippers to a predetermined position from which they are angularly moved relative to the drive members upon engagement with the bag material.

Preferably, the machine includes a mounting member fixed to each drive member, with the stripper brackets and deflector brackets being pivotally attached to a respective one of the mounting members.

Preferably, one of the bar members is provided with a longitudinally standing projection and the other bar member with a longitudinally extending recess within which the projection is received with the bag material so as to be deflected thereby.

Preferably, one of the bar members includes a longitudinally extending recess and the other bar member a longitudinally extending projection to be received in the recess with the bag material so that the bag material is laterally deflected at three locations spaced along the bag material.

In an alternative configuration one of the bar members is located upstream along the bag material relative to the other bar member.

In an alternative configuration the deflecting and closing members include a pair of closing members which engage the tubular bag material to close the tubular bag material, and a deflecting member that engages the tubular bag material downstream of the closing members, which deflecting member laterally deflects the tubular bag material.

DETAILED DESCRIPTION OF THE PREFERRED EMBODIMENTS

Figure 1:
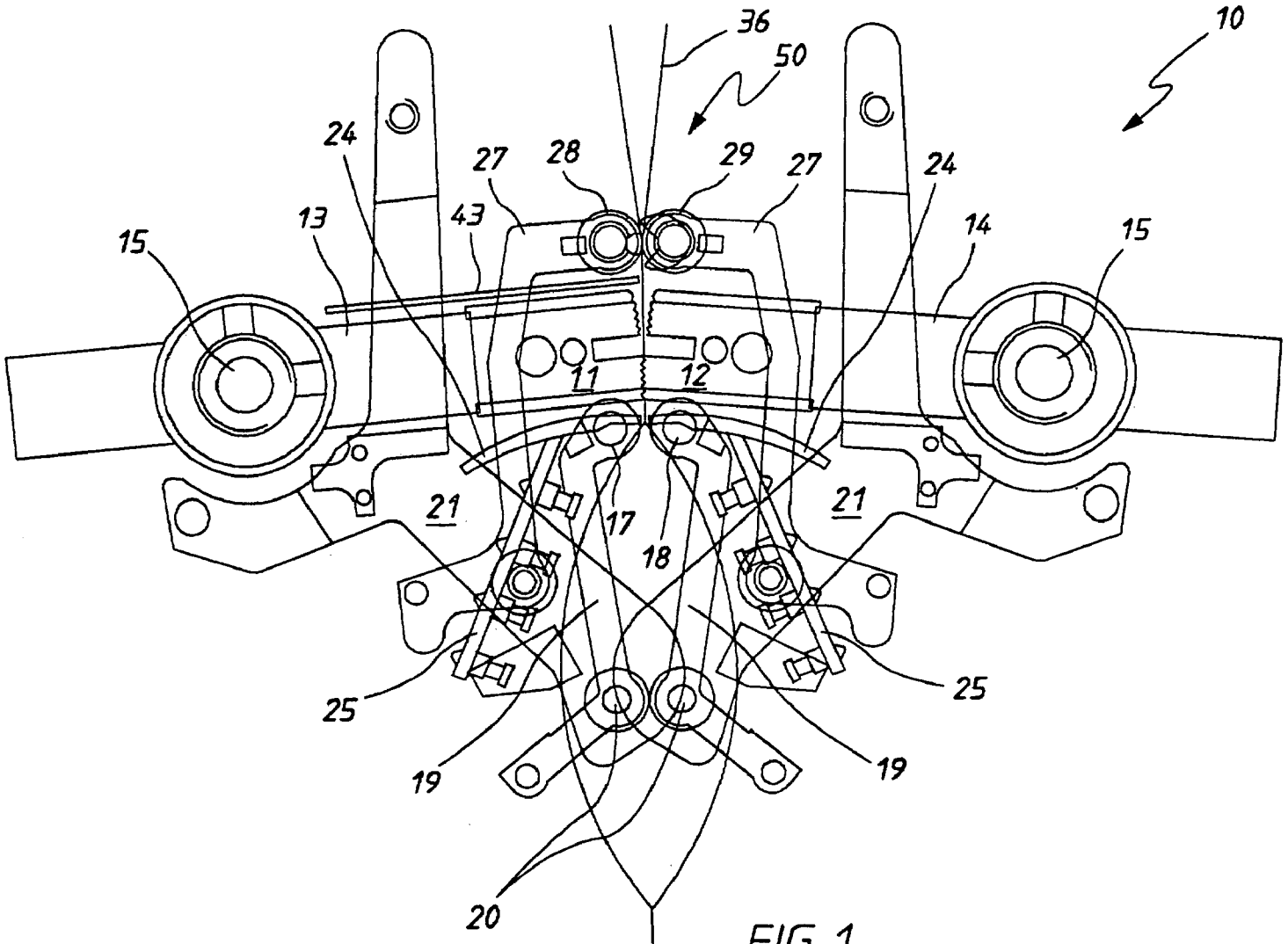
FIG. 1 is a schematic side elevation of a packaging machine.

In FIGS. 1 and 5–11 of the accompanying drawings there is schematically depicted a packaging machine 10. The machine 10 is a rotary packaging machine to which there is delivered tubular bag material 36 within which product is located. The machine 10 forms transverse seals in the tubular bag material 36 and transversely cuts the tubular bag material 36 to form discrete bags 37.

The transverse seals are formed and the tubular bag material 36 cut by sealing heads 11 and 12 which are mounted on arms (driver members) 13 and 14. That is, the heads 11 and 12 have a knife blade. The arms 13 and 14 extend radially from shafts 15 and 16, which shafts 15 and 16 are rotatably driven through repeated revolutions in synchronism in opposite rotational directions about spaced parallel generally horizontal axes. The shafts 15 and 16 have generally horizontal, parallel and transversely spaced longitudinal axes. In this embodiment, the axes are substantially stationary except for movement required for the purpose of ensuring correct contact between the sealing heads 11 and 12. However, one or both of the shafts 15 and 16 may be mounted for limited horizontal and/or limited vertical movement if so required.

Also mounted on arms 13 and 14 are stripper bars 17 and 18 respectively, each extending between a pair of support brackets 19. Each bracket 19 is pivotally supported by means of a shaft 20 on a support (mounting) member 21. Each support member 21 in turn is mounted on its associated arm 13, 14 so as to be fixed with respect thereto.

Extending between each bracket 19 and the member 21 is a spring 22 urging the associated bracket 19 to engage a stop 23. The stops 23 define the rest positions of the stripper bars 17 and 18. Each stripper bar 17 and 18 includes an arcuate bag shield 24 and projections 25 between which bag "deflator" springs 26 extend.

Also mounted on the support member 21 is a pair of support brackets 27 between which there extend tubular bag deflecting members which in this embodiment are in the form of tube closer bars 28 and 29. Extending between each bracket 27 and the member 21 is a spring 30 which passes round a pulley 31 to be secured at location 32 on the member 21. Each support 21 is urged by the spring 30 to engage a stop 33. Accordingly, the stops 33 define rest positions for the closer bars 28 and 29.

In this embodiment the closer bar 28 has a longitudinally extending projection 34 that engages within a longitudinally extending recess 35 of the bar 29.

When the projection 34 enters the recess 35, together with the tubular bag material 36, the tubular bag material 36 is caused to follow a tortuous path; that is, it is first deflected in a direction lateral (transverse) of the normal direction of travel of the tubular bag material 36, and then is subsequently deflected in the reverse direction. That is, the bag material 36 is deflected at three longitudinally spaced locations 52.

The brackets 27 are each pivotally supported by means of a shaft 38 on the associated support member 21. As the support members 21 are attached to and rotate with the arms 13 and 14, the bars 28 and 29 not only move angularly with the heads 11 and 12, but can also angularly move relative to the heads 11 and 12 as a result of the brackets 27 being pivotally mounted on the support members 21.

With respect to the above preferred embodiment it should be appreciated that the sealing heads 11 and 12 are essentially fixed relative to their associated arms 13 and 14. There is some limited movement to facilitate sealing. However, the above-described arrangement is also applicable to "flat jaw" rotary machines, that is, arrangements in which the heads 11 and 12 follow arcuate paths but are connected by rods so that their orientation does not change during their cycle.

In the above-described preferred embodiment the bars 28 and 29 rotate in unison in opposite directions through repeated revolutions, as a result of being mounted on arms 13 and 14, so that they are aligned transversely of the tubular bag material 36 when engaging therewith. However, in an alternative embodiment tube closer bars 28 and 29 may be employed (not necessarily having the recess 35 and projection 34) which are not aligned; that is, the bar 28 for example could be angularly ahead of the bar 29 so that they are no longer transversely aligned when engaged with the bag material 36. In such an arrangement the tubular bag material 36 is again deflected in a first direction transverse of the normal direction of travel of the tubular bag material 36 and then deflected in the reverse direction.

In the above-described preferred embodiment the stripper bars 17 and 18 advance down the tubular bag material 36 to perform a "stripping" function. That is, the bars 17 and 18 advance down the tubular bag material 36 to reduce the volume occupied by the product being packaged. Thereafter, the heads 11 and 12 engage the tubular bag material 36 to form the transverse seal and to cut the bag 37 from the tubular bag material 36. As can be noted from FIG. 1, the bag deflecting members, that is, tube closer bars 28 and 29, are located immediately above the heads 11 and 12 and prevent product delivered to the interior of the tubular bag material 36 from falling to a position at which the product is located between the heads 11 and 12. As can be seen from FIG. 1 the heads 11 and 12 have corrugated faces. These faces advance the tubular bag material 36, but not to the extent where product, such as crumbs, is pulled past the bars 28 and 29 and allowed to fall to a position between the heads 11 and 12. Thus the bars 28 and 29 provide deflecting and closing members.

Figure 2:
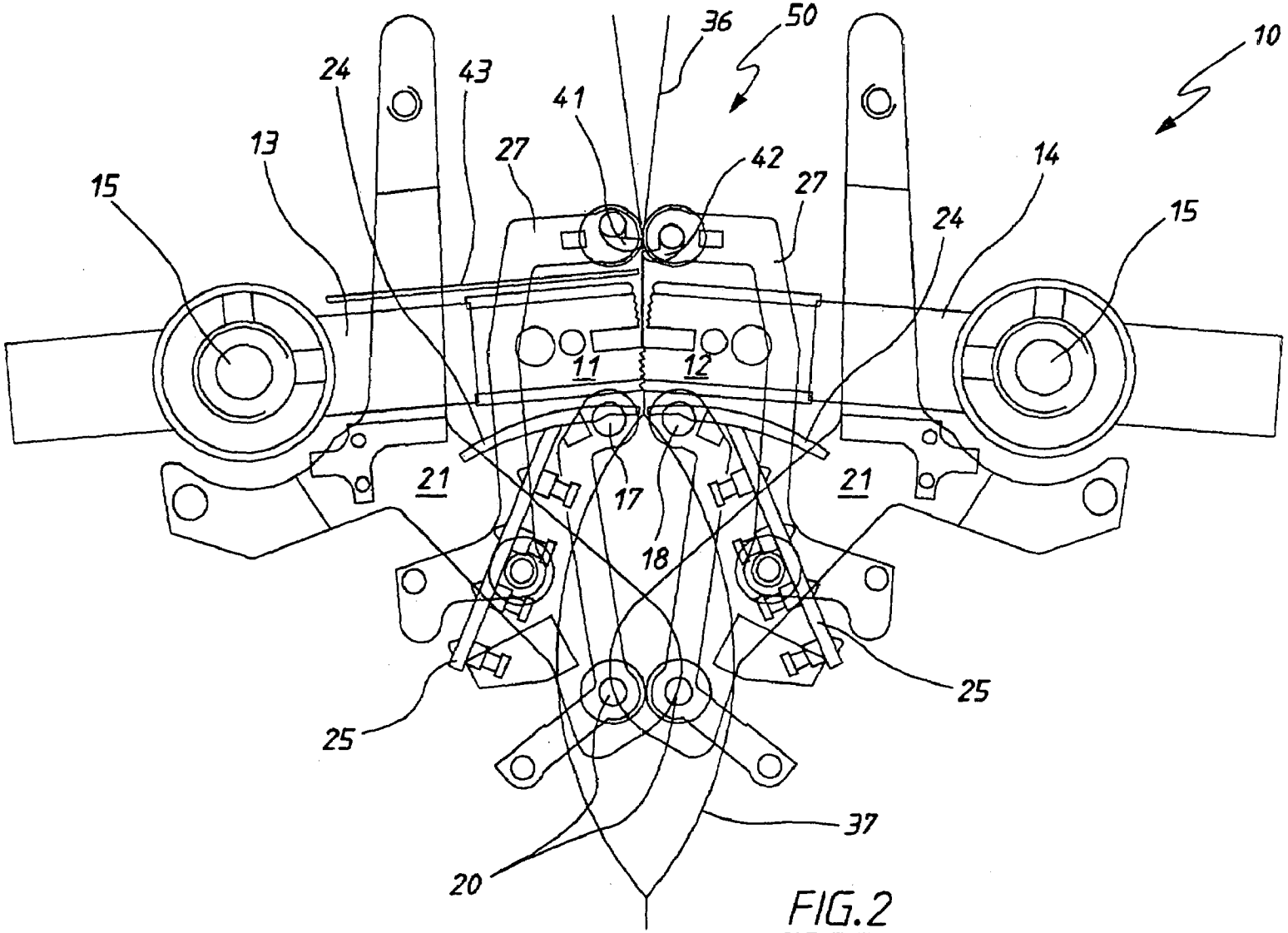
FIG. 2 is a schematic side elevation of a modification of the packaging machine of FIG. 1.

In the embodiment of FIG. 2 the bars 28 and 29 are of a different configuration. In this embodiment the bars 28 and 29 include longitudinally extending projections 41 and 42 that are not transversely aligned as in the case of the projection 34 and recess 35. More particularly, the projection 42 is located downstream from the tubular bag material 36 relative to the projection 41. The projection 41 deflects the tubular bag material 36 laterally (transversely) to the normal direction of travel of the tubular bag material 36, and the projection 42 deflects the tubular bag material 36 in the opposite direction. In this respect it should be appreciated that the projections 41 and 42 also act to close the tubular bag material 36 as well as deflect it. Accordingly, in this embodiment the projections 41 and 42 provide deflecting and closing members.

If so required, a still further deflecting member 43 can be used. The deflecting member 43 is mounted directly on the arm 13 so as to rotate therewith. The member 43 engages the tubular bag material 36 in between the deflecting members 41 and 42 and the heads 11 and 12. In this respect it should be appreciated that the member 43 is fixed relative to the heads 11 and 12 while the projections 41 and 42 move relative to the heads 11 and 12, when the projections 41 and 42 are engaged with the tubular bag material 36.

The projections 41 and 42, as discussed above, also act as tube closer bars. They are mounted in a similar manner to the bars 28 and 29.

Figure 3:
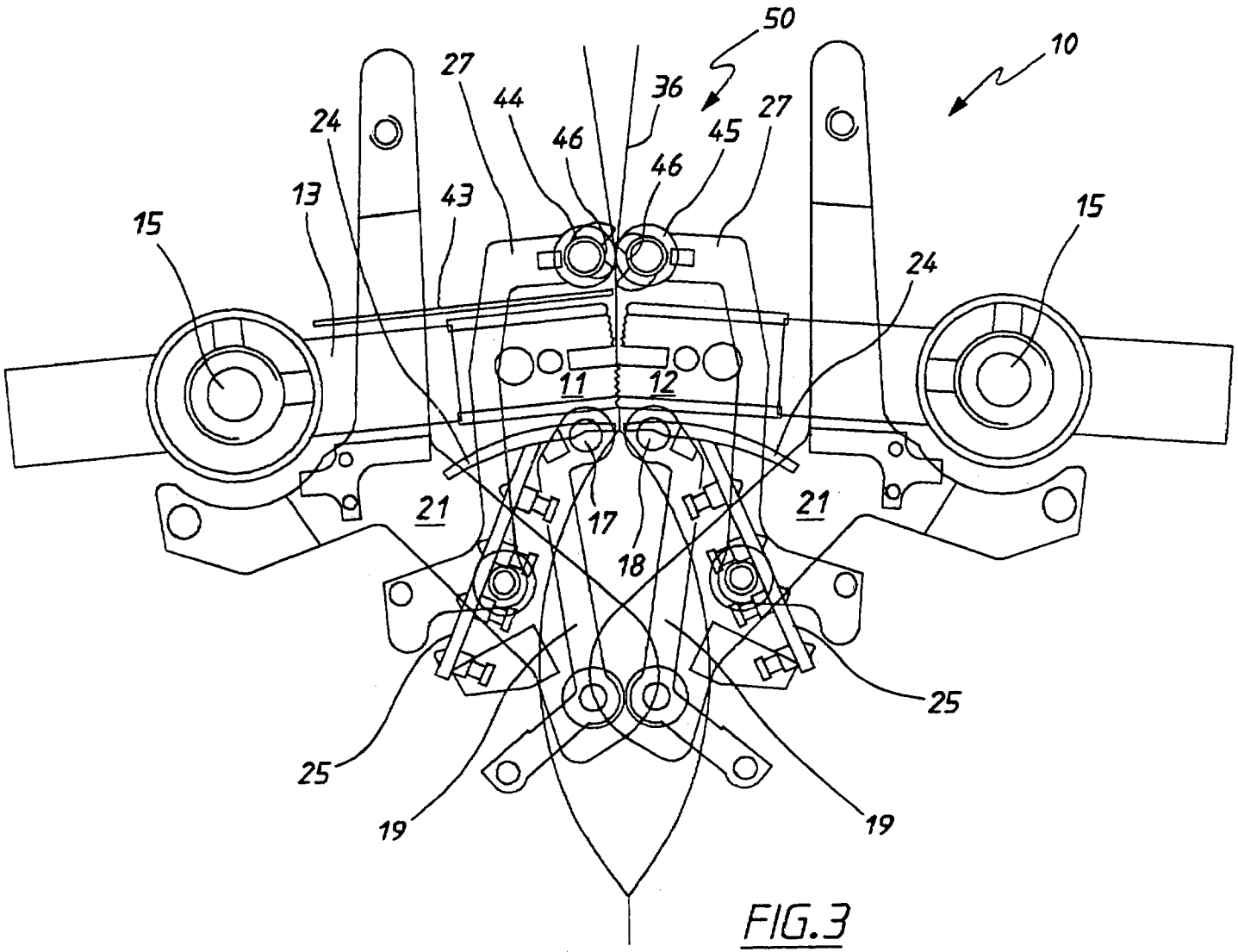
FIG. 3 is a schematic side elevation of a further modification of the packaging machine of FIG. 1.

In the embodiment of FIG. 3, the tube closer bars 28 and 29 are each provided with a "C"-shaped engagement member 44 or 45, so that each engagement member 44, 45 has a recess 46. Projecting into each recess 46 is a portion of the other engagement member 44, 45. Accordingly, the members 44 and 45 are not transversely aligned relative to the tubular bag material 36; that is, the engagement member 45 is located closer to the heads 11 and 12 than the engagement member 44. The engagement member acts as bag material deflecting and closing member.

As discussed earlier, if desirable, a further deflection member 43 could be used.

Figure 4:
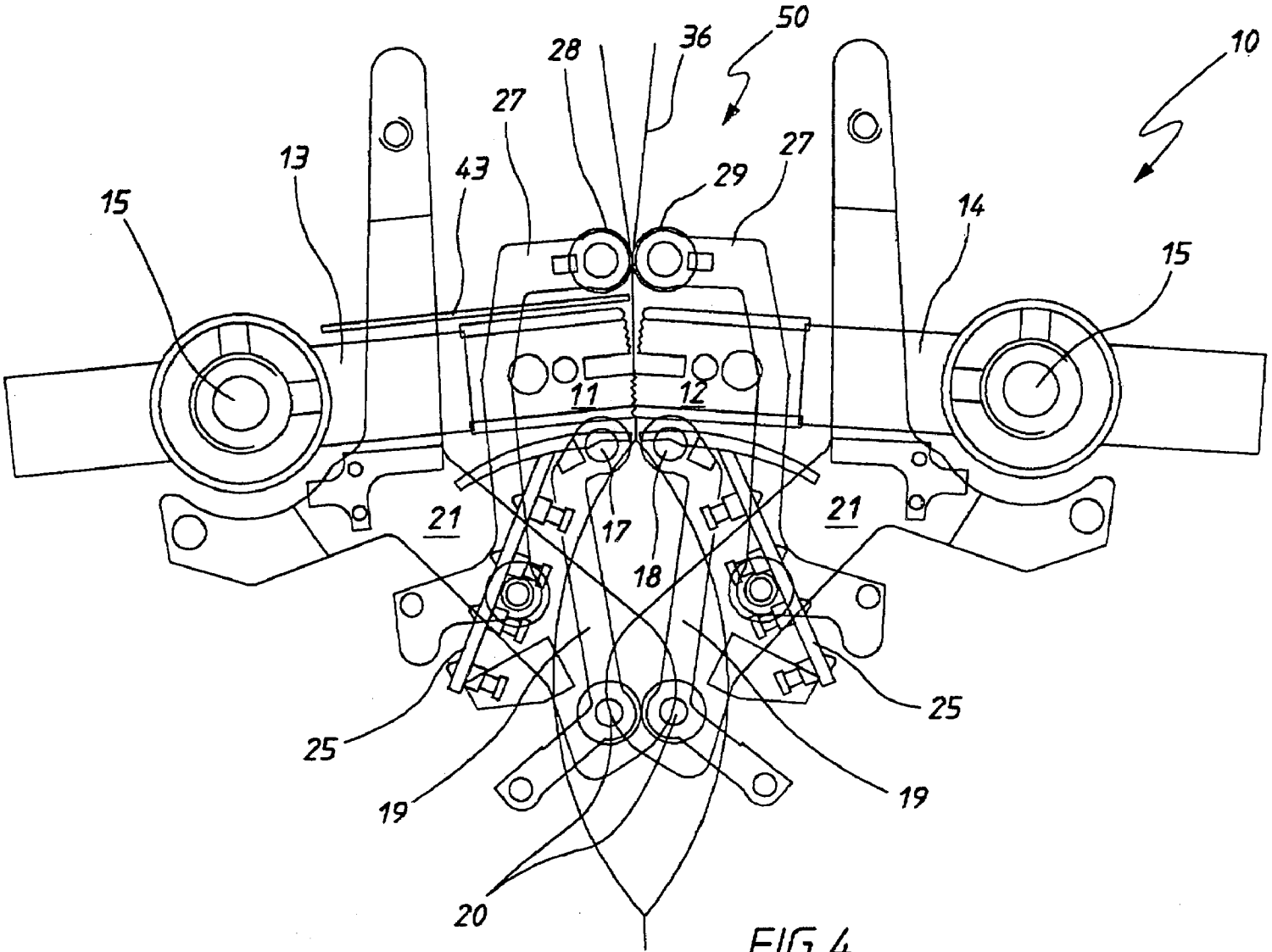
FIG. 4 is a schematic side elevation of a still further modification of the packaging machine of FIG. 1.
Figure 5:
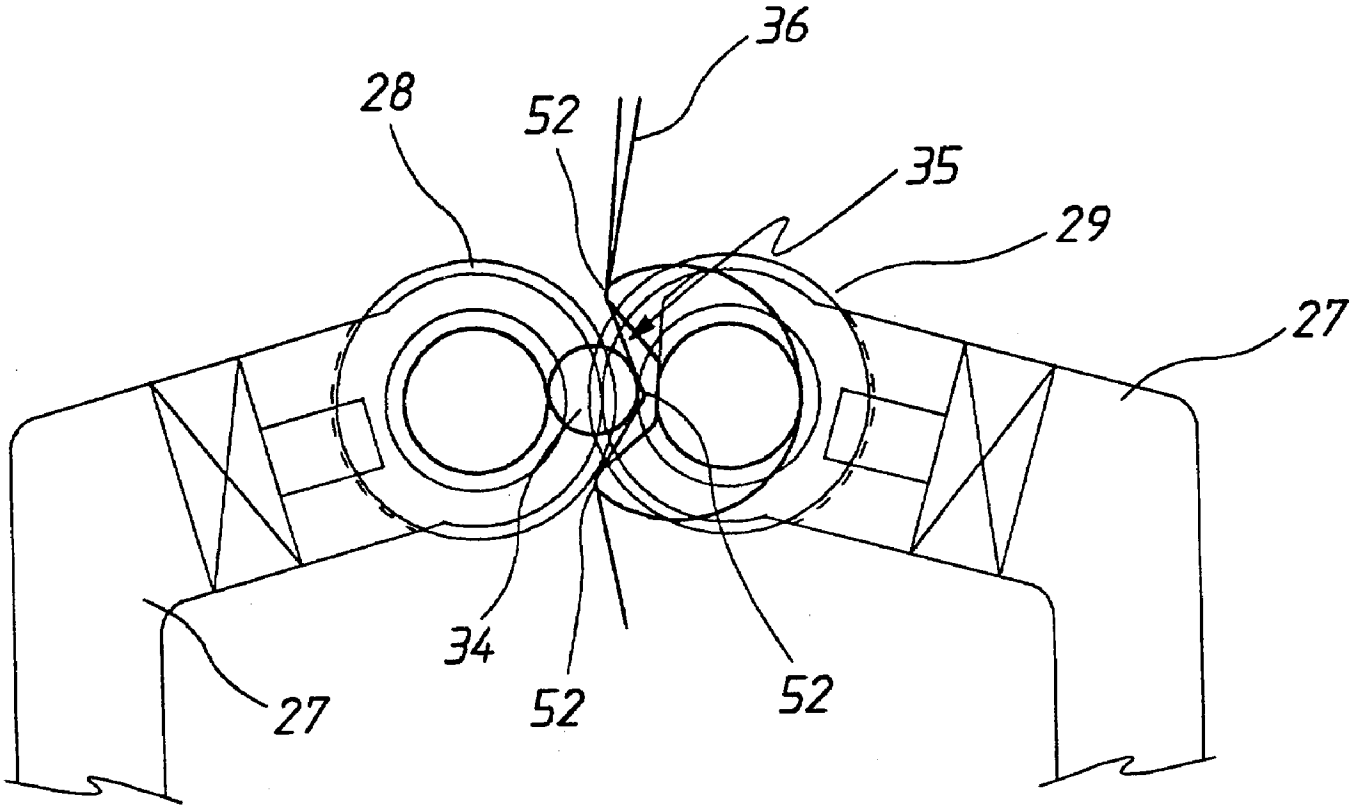
FIG. 5 is a schematic side elevation of a pair of cooperating deflection members employed in the packaging machine of FIG. 1.
Figure 6:
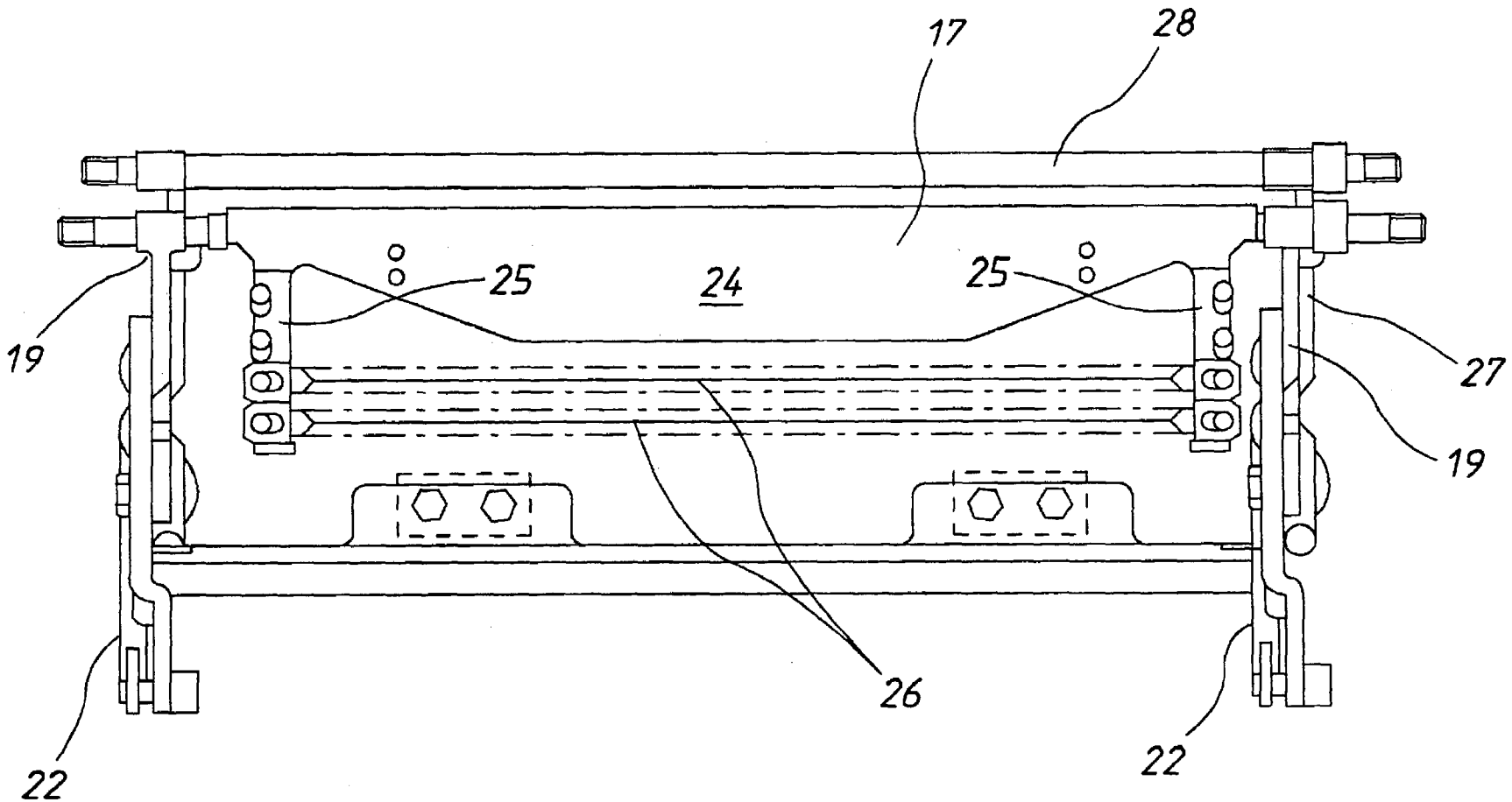
FIG. 6 is a schematic front elevation of an assembly including deflection members and stripper members of the packaging machine of FIG. 1.
Figure 7:
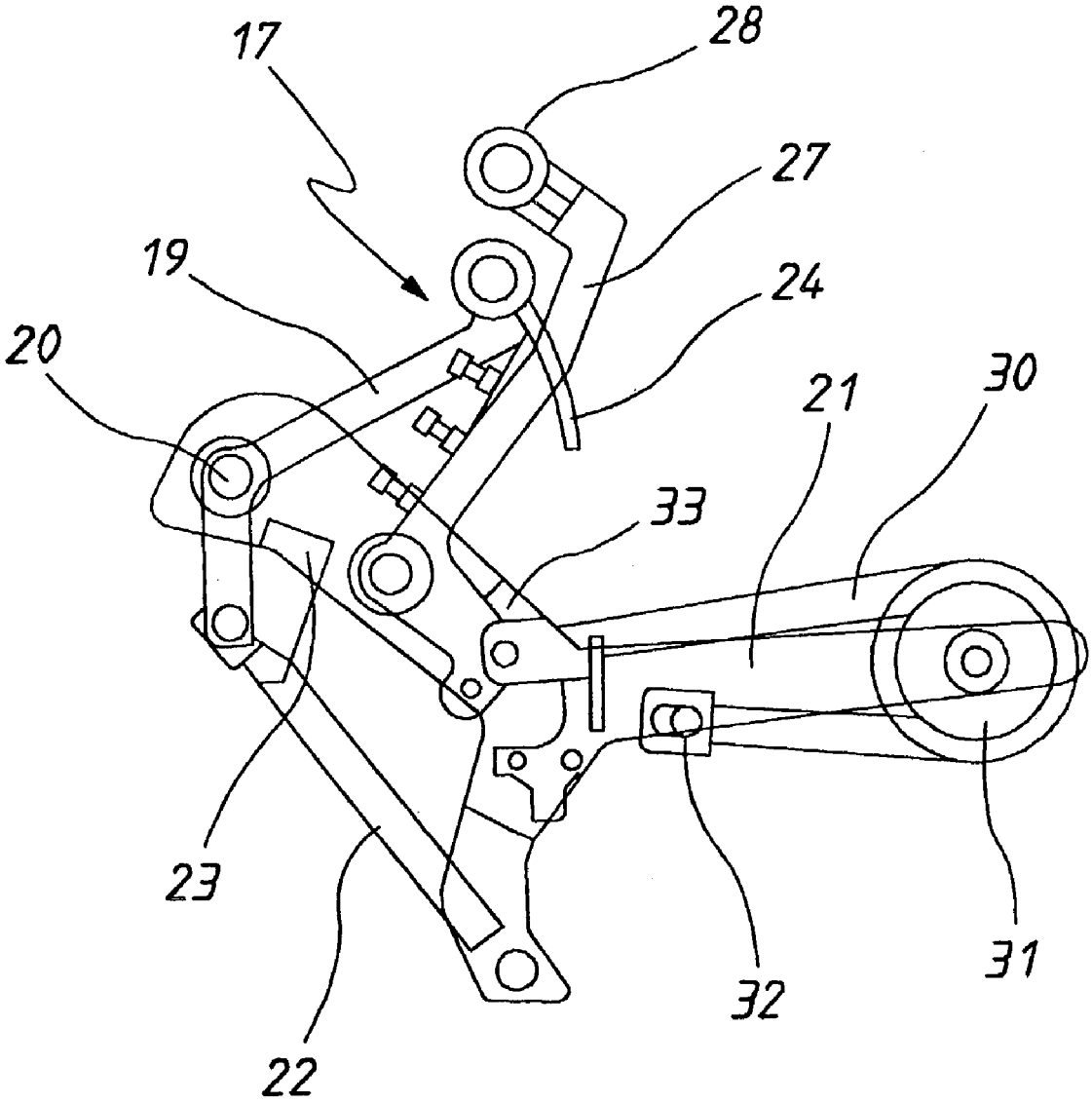
FIG. 7 is a schematic end elevation of the assembly of FIG. 6.
Figure 8:
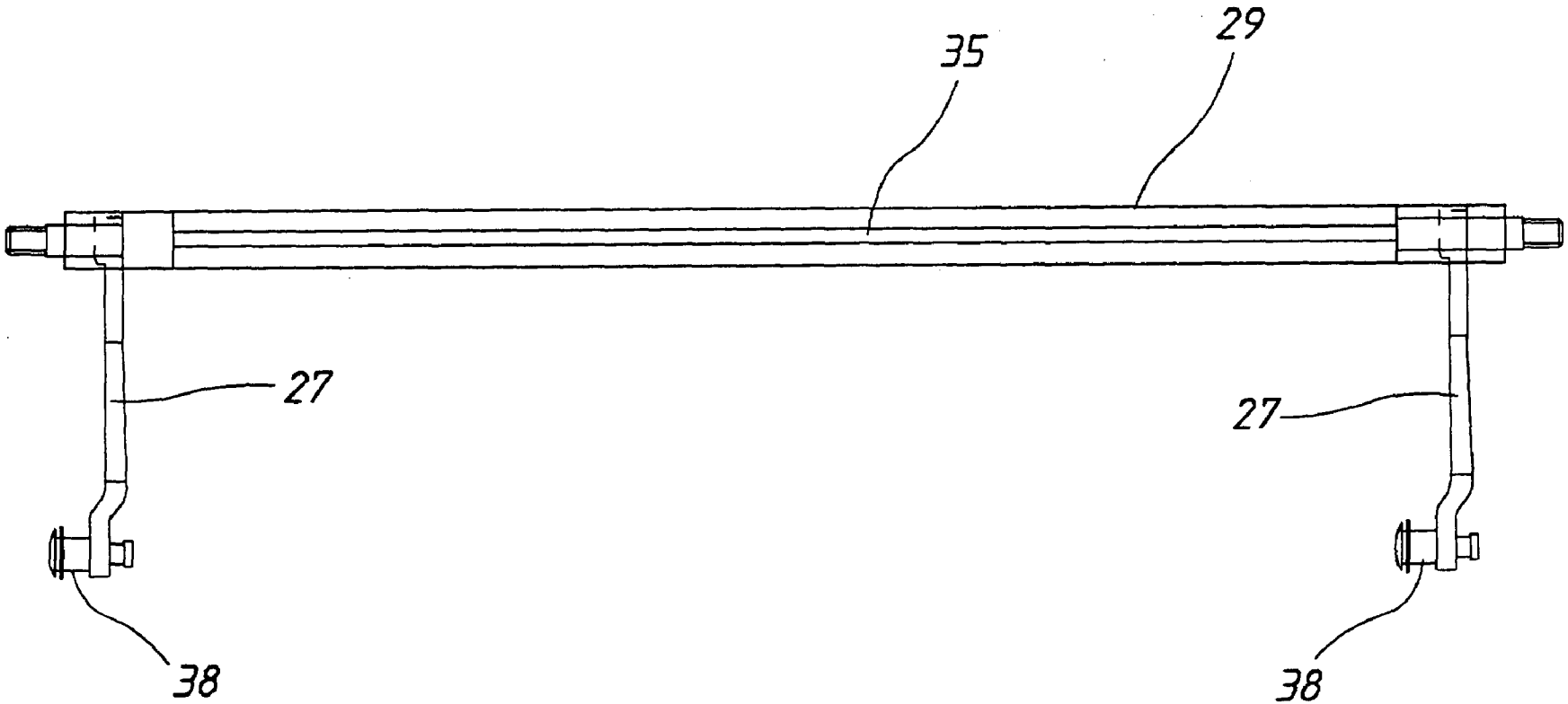
FIG. 8 is a schematic front elevation of one of the deflection members of FIG. 5.
Figure 9:
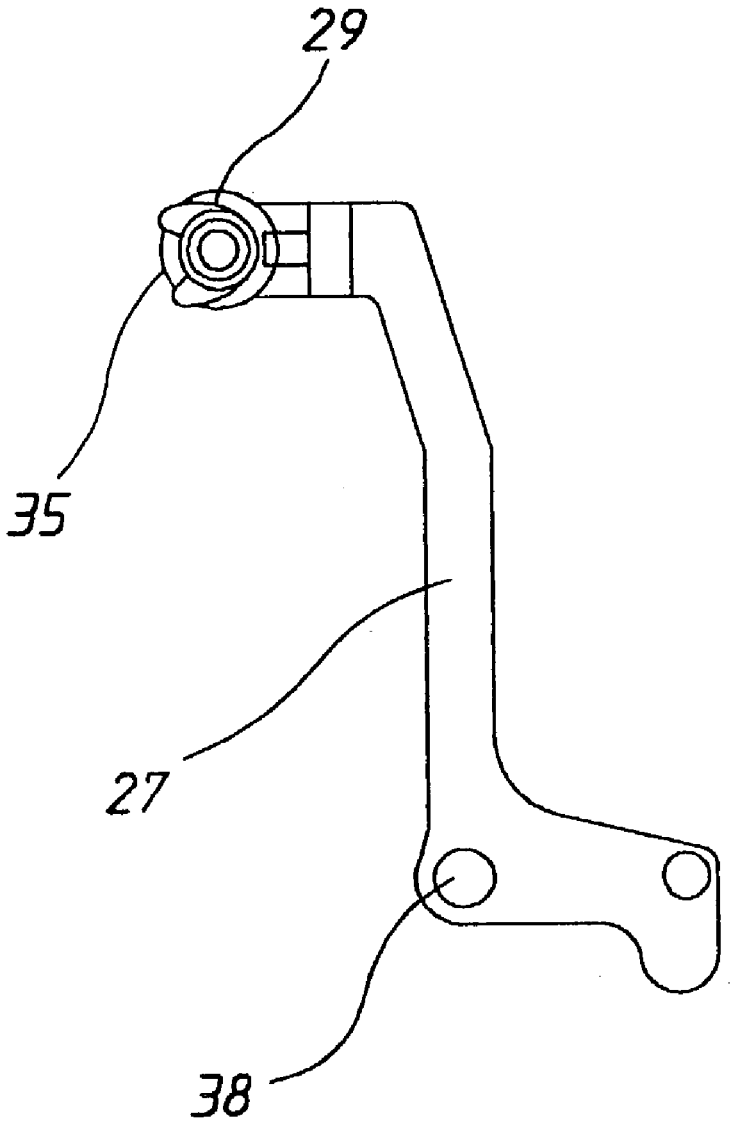
FIG. 9 is a schematic end elevation of the deflection member of FIG. 8.
Figure 10:
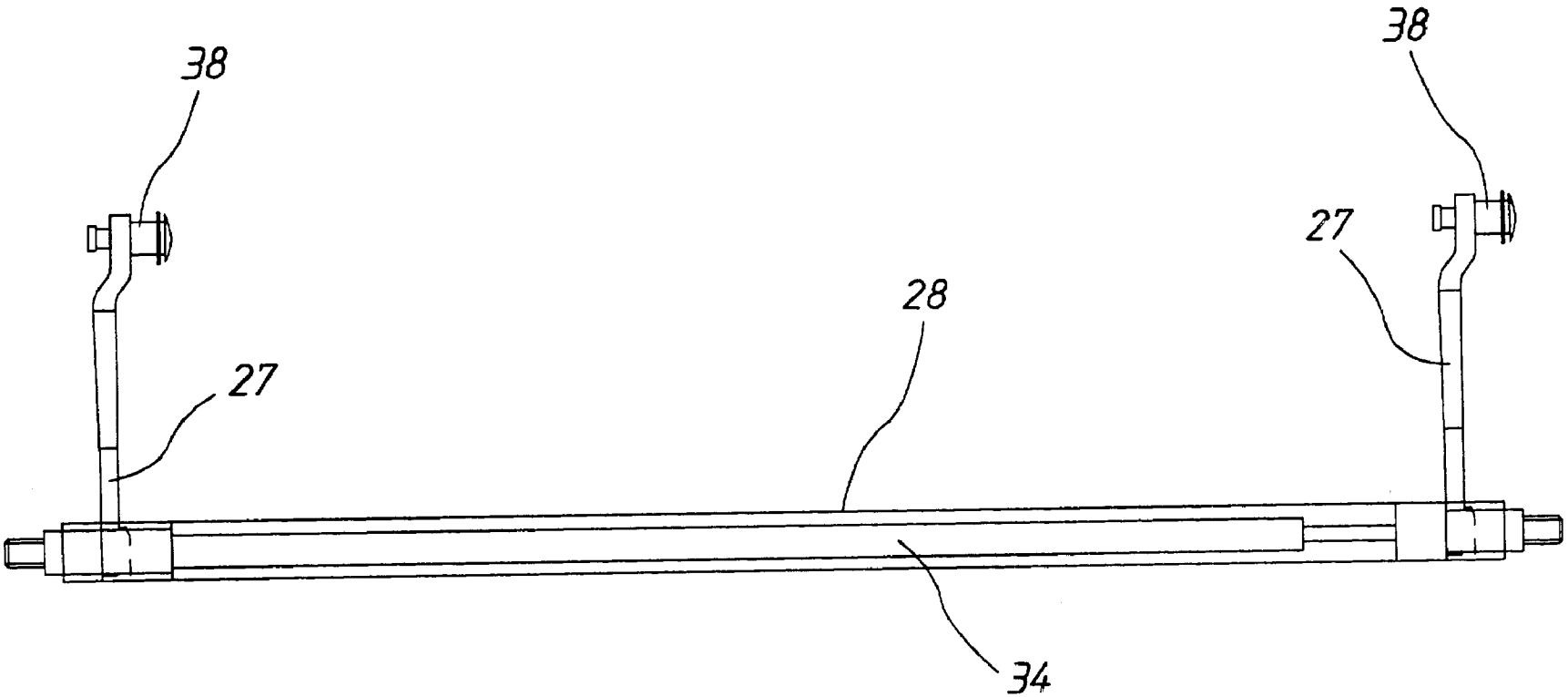
FIG. 10 is a schematic front elevation of the other deflection member of FIG. 5.
Figure 11:
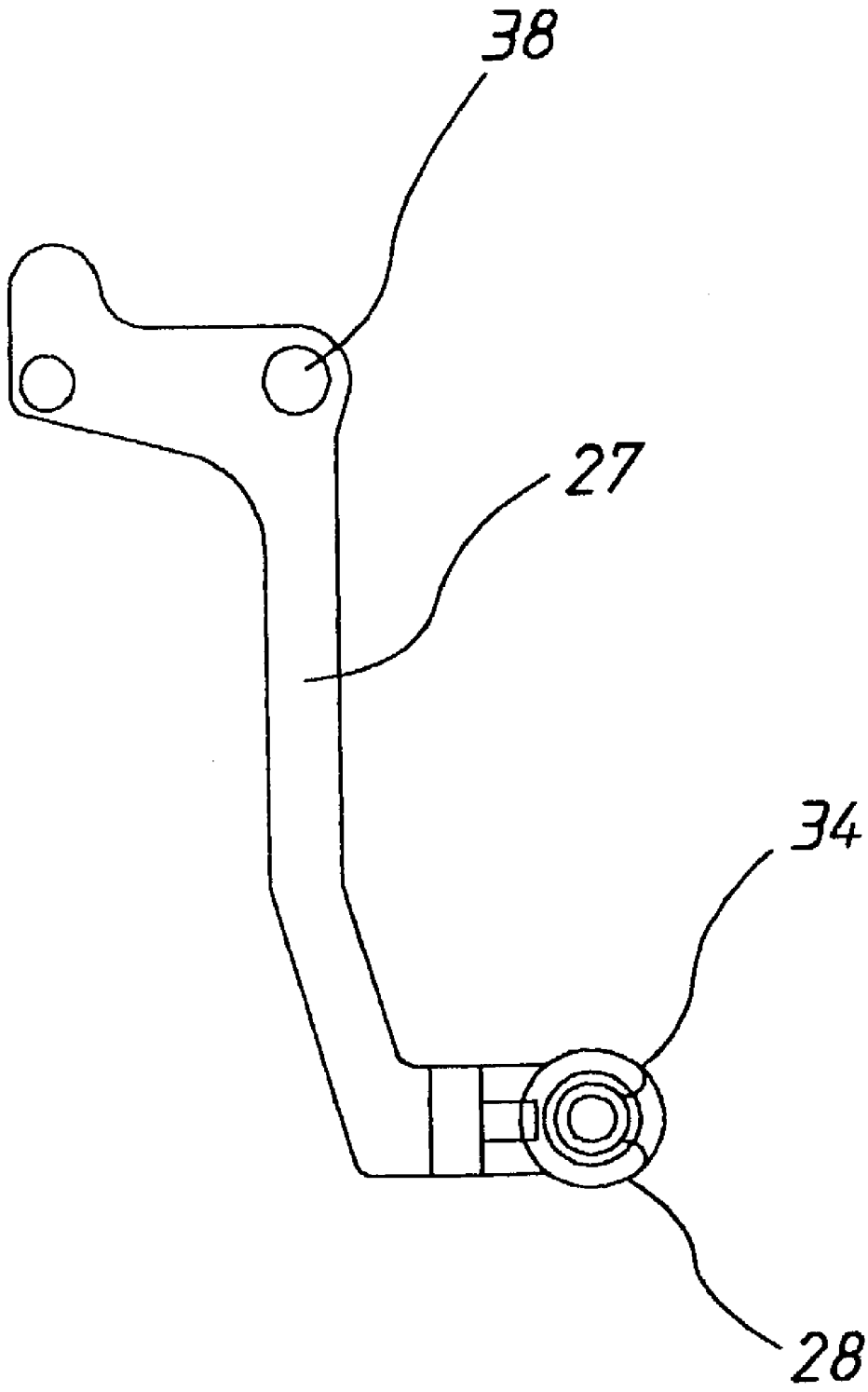
FIG. 11 is a schematic end elevation of the deflection member of FIG. 10.

In the embodiment of FIG. 4, the tube closer bars 28 and 29 are of a circular transverse cross-section so as not to have any projections or recesses. However, deflection of the tubular bag material 36 is performed by the member 43, as discussed previously.

In an alternative arrangement, as shown in FIG. 4, a single bag deflection member 43 may be employed with tube closer bars 28 and 29 (not necessarily having the projection 34 and recess 35). The bag deflection member 43 is mounted with one of the heads 11 or 12 so as to rotate therewith, and to engage the bag material 36 to cause deflection thereof. Accordingly, the bag material deflecting and closing members are provided by the bars 28 and 29 and the member 43. It should be noted that the bars 28 and 29, while being mounted on the supports 21, move angularly relative to the heads 11 and 12 when the bars 28 and 29 are engaged.

In the above-described preferred embodiments the tubular bag material 36 is deflected from its normal direction of travel by one or more bag material deflecting members. In a number of embodiments the bag material deflecting members are tube closer bars 28 and 29 while in another embodiment a bag material deflecting member 43 is employed with a pair of tube closer bars 28 and 29. By deflecting the tubular bag material 36 as discussed above, product (particularly crumbs) is inhibited from being located between the sealing heads 11 and 12. Tubular bag material 36 that is advanced relative to the bag material deflecting members, for example the bars 28 and 29, is not advanced to the extent that crumbs will pass the bars 28 and 29 and enter the area between the heads 11 and 12. As the deflecting members rotate with the jaws 11 and 12, the deflecting members move between being spaced from the bag material 36 allowing product to pass along the bag material 36, and being engaged with the bag material 36 to at least substantially prevent material being located between the sealing jaws 11 and 12. Thus each of the above embodiments includes an assembly 50 which in a first operative configuration allows product to pass along the bag material 36, while in a second operative configuration at least substantially prevents product passing along the bag material past the deflecting members and being located between the jaws 11 and 12.

The invention claimed is:

1. A rotary packaging machine including:

a pair of rotatably driven jaws to engage tubular bag material passing through the machine in a general direction of travel, the jaws being adapted to form transverse seals in the bag material to form discrete bags containing product;

a drive member supporting each jaw, the drive members being driven in synchronism in opposite rotational directions; and an assembly to at least substantially prevent product being located between the jaws during sealing engagement with the tubular bag material, said assembly having a first operative configuration allowing product to pass along the bag material and a second operative configuration, said assembly when in said second configuration being engaged with the bag material to at least substantially prevent product being located between the jaws during sealing, said assembly including bag material deflecting and closing members mounted on said drive members so as to rotate therewith, which deflecting and closing members close said bag material and deflect the closed bag material laterally relative to said direction to at least substantially prevent product being located between the jaws when forming said seals.

2. The machine of claim 1 wherein said deflecting and closing members include:

a pair of bar members which deflect and close said tubular bag material, a deflector bracket for each bar member, each bracket mounting the associated one of the bar members on a respective one of the drive members, and wherein the brackets provide for relative movement between each bar member and the jaw of the respective drive member so that each bar member moves relative to its associated jaw when the bar member is engaged with the tubular bag material.

3. The machine of claim 2 wherein the bar members are configured to also close the bag material; and said machine further includes strippers that engage the bag material downstream of the bar members in said direction to strip the bag material prior to sealing, said strippers being mounted on the drive members so that each drive member has mounted on it one of the bar members and one of the strippers.

4. The machine of claim 3 wherein each deflector bracket is pivotally mounted on its respective drive member so that the bar members move angularly relative to the respective one of the drive members, and said machine further includes a pair of stripper brackets that support the strippers, each, stripper bracket being pivotally mounted on a respective one of the drive members so that the strippers move angularly relative to their respective drive members.

5. The machine of claim 4 wherein the machine further includes first springs urging the bar members to a predetermined position from which the bar members are angularly moved relative to said drive members upon engagement with the bag material, and second springs urging the strippers to a predetermined position from which they are angularly moved relative to the drive members upon engagement with the bag material.

6. The machine of claim 5 wherein said machine includes a mounting member fixed to each drive member, with the stripper brackets and deflector brackets being pivotally attached to a respective one of the mounting members.

7. The machine of claim 6 wherein one of the bar members is provided with a longitudinally standing projection and the other bar member with a longitudinally extending recess within which the projection is received with the bag material so as to be deflected thereby.

8. The machine of claim 1 wherein the bar members deflect the tubular bag material laterally in one direction and laterally in the opposite direction to said one direction.

9. The machine of claim 8 wherein one of the bar members includes a longitudinally extending recess and the other bar member a longitudinally extending projection received in said recess with said bag material so that said bag material is laterally deflected at three locations spaced along the bag material.

10. The machine of claim 8 wherein one of the bar members is located upstream along the bag material relative to the other bar member.

11. The machine of claim 1 wherein the deflecting and closing members include a pair of closing members which engage the tubular bag material to close the tubular bag material, and a deflecting member that engages the tubular bag material downstream of the closing members, which deflecting member laterally deflects the tubular bag material.

12. The machine of claim 1 wherein the deflecting and closing members are a pair of bar members, each bar member being pivotally mounted on a respective one of the drive members, one of said bar members having a longitudinally extending recess and the other bar member having a longitudinally extending projection received within the recess with the bag material to cause deflection and closing thereof.

13. The machine of claim 12 further including strippers pivotally mounted on the drive member that engage its bag material down stream in said direction from said bar members.

* * * * *